US006648595B2

(12) United States Patent
Laing

(10) Patent No.: US 6,648,595 B2
(45) Date of Patent: Nov. 18, 2003

(54) PUMP WITH SELECTABLE SUCTION PORTS

(76) Inventor: Karsten Andreas Laing, 1253 La Jolla Rancho Rd., La Jolla, CA (US) 92037

( * ) Notice: Subject to any disclaimer, the term of this patent is extended or adjusted under 35 U.S.C. 154(b) by 1 day.

(21) Appl. No.: 10/054,456

(22) Filed: Jan. 24, 2002

(65) Prior Publication Data

US 2002/0071775 A1 Jun. 13, 2002

(30) Foreign Application Priority Data

Dec. 13, 2000 (DE) ..... 100 62 207

(51) Int. Cl.[7] ..... F04D 29/50
(52) U.S. Cl. ..... 415/147

(58) Field of Search ..... 415/104, 144, 415/207, 211.2, 152.1, 147, 911

(56) References Cited

U.S. PATENT DOCUMENTS 4,091,644 A * 5/1978 Bochan ..... 68/18 F
4,728,260 A * 3/1988 Ishii ..... 415/151
4,923,366 A * 5/1990 Kern et al. ..... 415/152.1

* cited by examiner

*Primary Examiner*—Ninh H. Nguyen

(57) ABSTRACT

A circulator-pump-motor-unit which has two inlet ports and means to change the path of the hot water conveyed between these ports so that either the hot water system or the hydronic system gets heat.

1 Claim, 4 Drawing Sheets

PUMP WITH SELECTABLE SUCTION PORTS
Laing Karsten

PUMP WITH SELECTABLE SUCTION PORTS

FIELD OF THE INVENTION

The invention refers to circulator pumps with two inlet ports and means to control these ports.

PRIOR ART

Instant hot water heaters are used alternatively to heat the domestic hot water and the heat carrier water of hydronic systems. For this purpose a three-way-valve is connected in series with the circulator pump whose first inlet port is connected with the domestic hot water circuit and whose second inlet port is connected with the hydronic circuit. When hot water is needed, the first inlet port is connected with the suction port of the impeller of the circulator pump; the change to room heating requires the closing of this first port and the opening of the second port, which needs two solenoid valves.

SUMMARY OF THE INVENTION

The invention shows a way to switch the suction port of a circulator pump from the first to the second circuit without any valves. This method is not restricted to circulator pumps for instant hot water heaters. According to the invention an electric circulator pump with spherical rotor is used, as described in claim 1 or the reversal of rotation of a circulator pump is used to switch between the two suction ports.

DETAILED DESCRIPTION OF THE DRAWINGS

Figures 1, 2, 3:
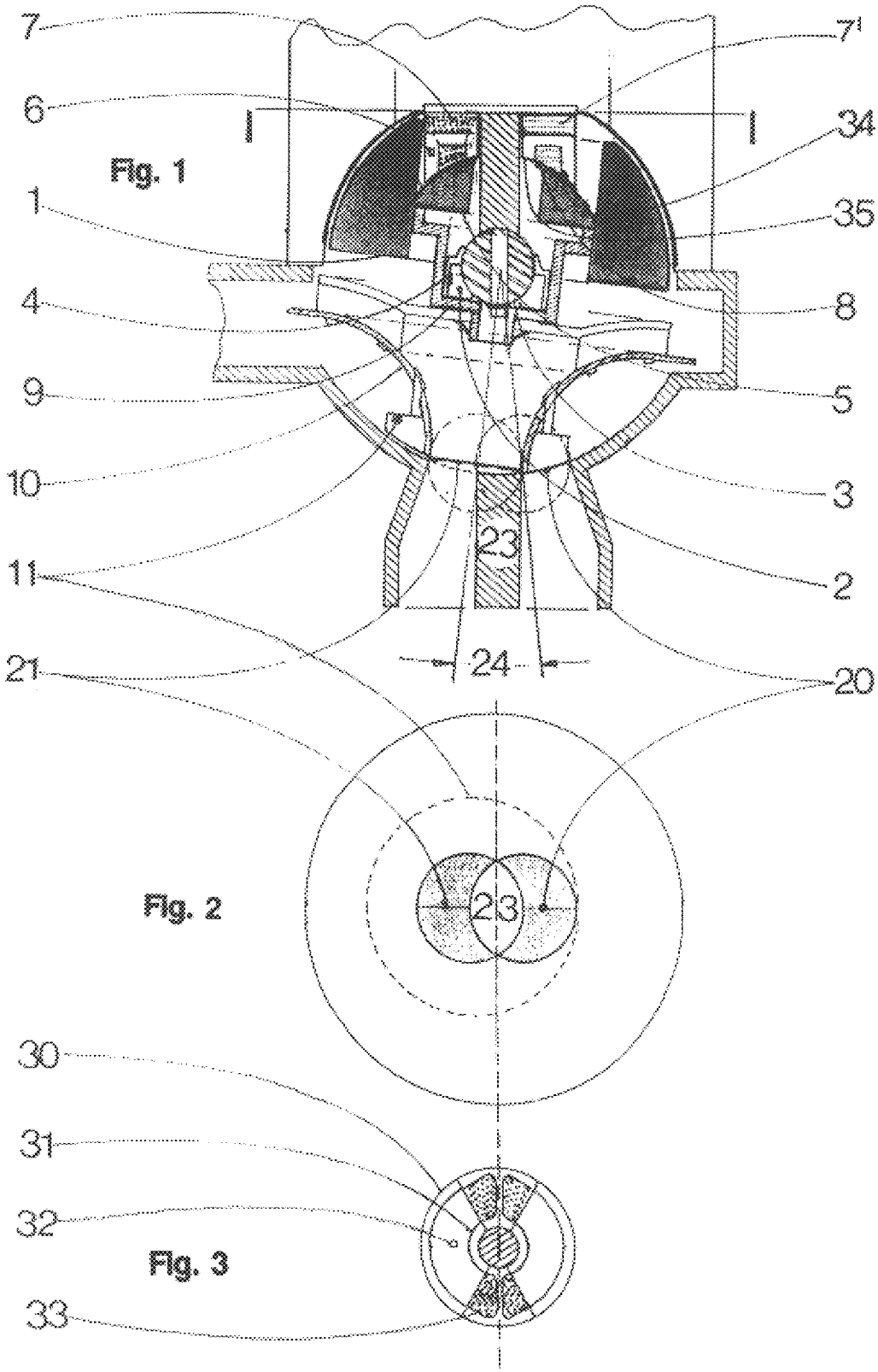
FIG. 1 shows a vertical cross-section through a circulator pump.
FIG. 2 shows the inside of the pump housing from above.
FIG. 3 shows the design of a double electromagnet.

In FIG. 1 the magnet of the rotor 1 of the spherical motor is supported by bearing cap 2 on ball 3. A ring 4, whose diameter is smaller than the diameter of the ball 3, prevents a lift up of the rotor-pump-impeller unit 1, 10 when the motor is switched off. A permanent magnetic ring 5 in the form of a spherical ring is arranged within the inner diameter of the magnetic rotor 1. The magnetic poles form concentric rings and lie on a spherical surface. Above the permanent magnetic ring 5 two electromagnets 6 with windings 7 are arranged, which are sealed from the liquid conveyed by the spherical wall 8. Via a cap 9 the magnetic rotor 1 is connected to pump impeller 10, which has a ring-shaped counterbalance 11 at its suction side. The electromagnets 6 and 7 can tilt the rotating unit 1, 5, 9, 10 into the shown oblique position to the left or alternatively to the right side.

FIG. 2 shows the crescent-shaped inlet ports 20 and 21, which are separated from each other by an almost lenticular body 23. The ring 11 of the pump impeller 10 is shown dashed. While the left inlet port 21 is open to the pump impeller 10, the ring 11 closes the right inlet port 20. A tilt by an angle 24 blocks the opposite inlet port.

FIG. 3 shows a top-view of the electromagnets 6 and 7' below the sectional plane I—I. The magnetic pole areas 30 and 31 are connected to each other by yoke 32, which lies inside winding 33. The spherical end portions of the pole areas 30 and 31 face the permanent magnetic ring 5. The upper portion of the winding 33 above yoke 32 is not shown. The current runs through the windings right and left of the symmetry-line in opposite direction. As can be seen in FIG. 1, the left electro magnet 7 pulls the permanent magnet ring 5 to the inside while the right electro magnet 7' in which the current runs in the opposite direction pushes the ring 5 to the opposite side.

Figure 4:
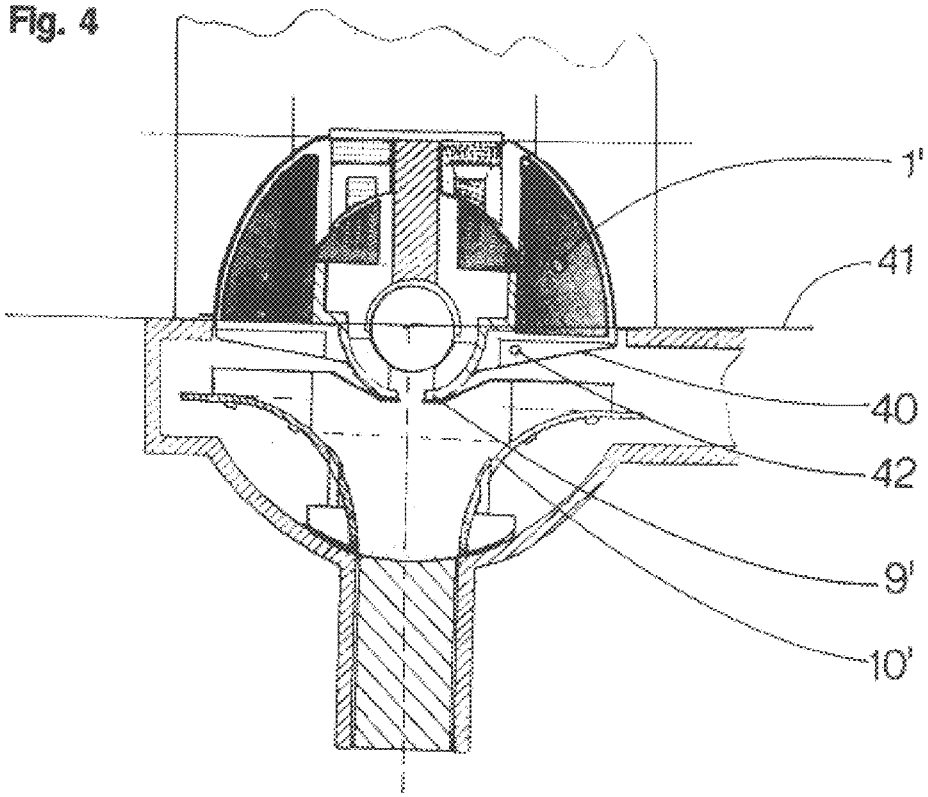
FIG. 4 shows a solution with a spherical ring at the inlet side of the pump impeller.

FIG. 4 shows another version, in which the concave space with the rotor 1' is separated from the pump area by a ring 40 which forms a narrow gap with the rotating hub 9', so that no dirt, for instance rust can get into the magnetic gaps. The axis 41 around which the rotor-pump impeller-unit 1', 10' can be tilted runs at a right angle to the view in FIG. 1. In the position in which the rotating unit 1', 10' is shown here the pump is not conveying. To prevent the flow of liquid within the annular space between the rotor 1' and the ring 40, which acts against the tilting of the rotating unit 1', 10' fins 42 are arranged parallel to the tilting axis 41.

Figures 5, 5A, 6:
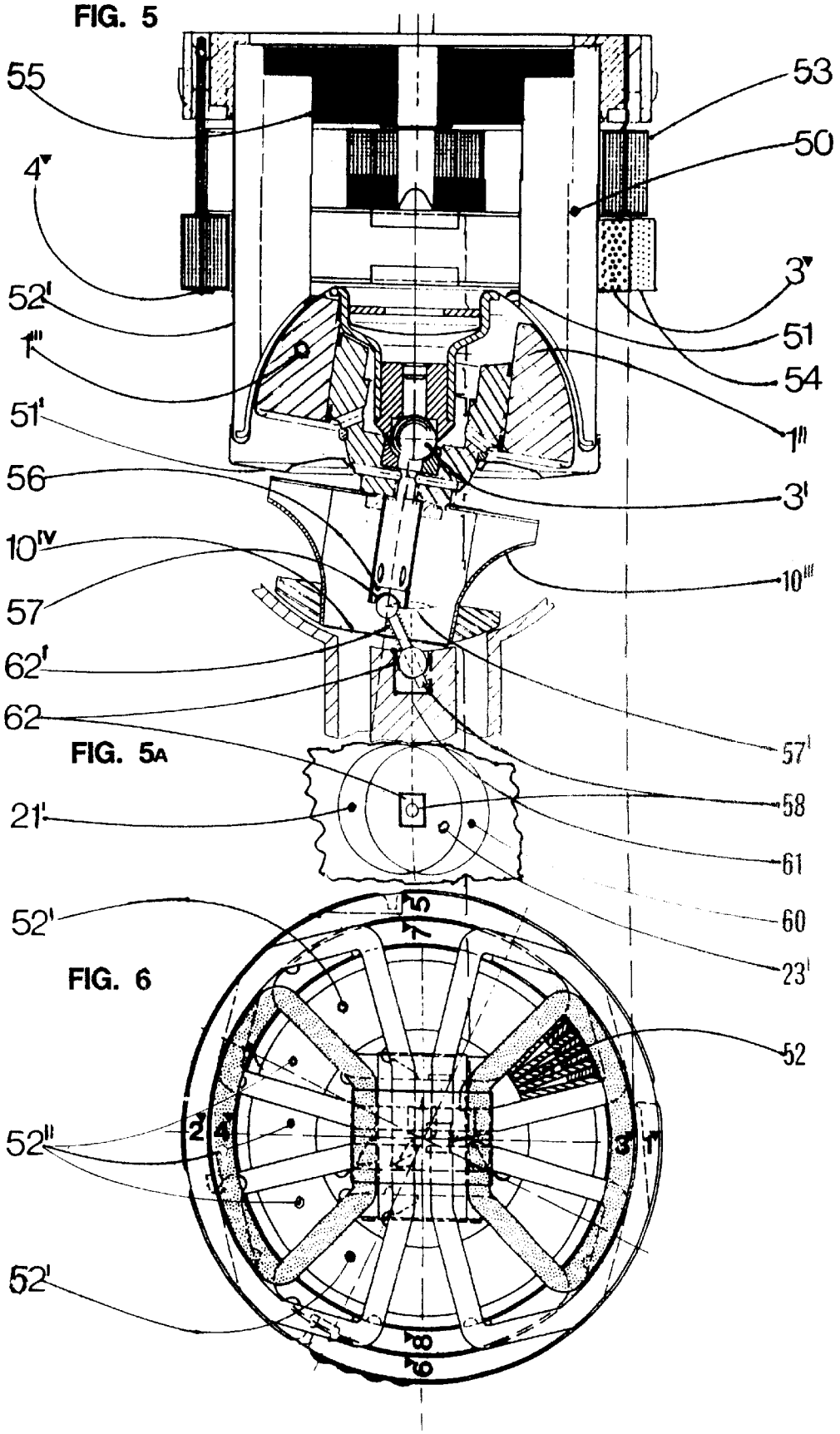
FIG. 5 shows a pump whose pump impeller is kept in a bistable position by a snap mechanism.
FIG. 6 shows a cross-section through the stator of the device of FIG. 5.

FIG. 5 shows the inner parts of a pump in a section parallel to the axis. FIG. 5*a* shows the crescent-shaped holes 21' and the lenticular dividing wall 23' lying in between.

FIG. 6 shows the top view of the stator 50 without the rotor 1" and the separating wall 51'. The stator 50 has twelve poles 52. The windings are arranged between neighboring poles. They have two layers. Each of these layers has two coils 1* and 2* respectively 5* and 6* which are wrapped around five poles and two coils 3* and 4* respectively 7* and 8* which are situated within the first set of coils which rap around three poles. When the pump is working alternating current is flowing through coils 3* and 4* which lie closest to the rotor 1". Together with a similar set of coils they produce the rotating magnetic field. In contrast to the six other coils these coils 3* and 4* are conductively connected to a device—not shown—which can produce a strong DC current surge. By such a current surge through coil 4* the three poles 52' act as direct current magnets with a north polarization, while the pole 52' forms the inherent south poles, whereby the poles 53' and 52' are magnetically connected via the iron yoke 55 so that they exert a strong attraction to the rotor side 1'" below, whereby the rotor-pump impeller-unit 1" and 10'" tilts around the horizontal axis which runs through the center of bearing ball 3' and vertical to the plane of the picture. Within the pump impeller 10'" close to the suction port $\mathbf{10}^{IV}$ bearing cap 56 is situated which rotates with the pump impeller. Bearing ball 57 extends into the bearing cap 56. The bearing ball 57 forms a unit with a guiding rod 58, which slides within the bore of cylinder 62. The cylinder 62 is tiltably guided within the recess 61 of the stationary, lenticular separating wall 23' between the two crescent-shaped openings 60 and 21'. Between this cylinder 62 and the bearing ball 57 a helical spring 62' is situated whose force is sufficient to keep the rotating system 1", 10'" in the respective sloping position. A change-over into the opposite sloping position is achieved by a DC current surge into coil 3*. Now the center of the bearing ball 57 moves along curve 57', whereby the spring 62' is compressed by a small amount.

Figure 7:
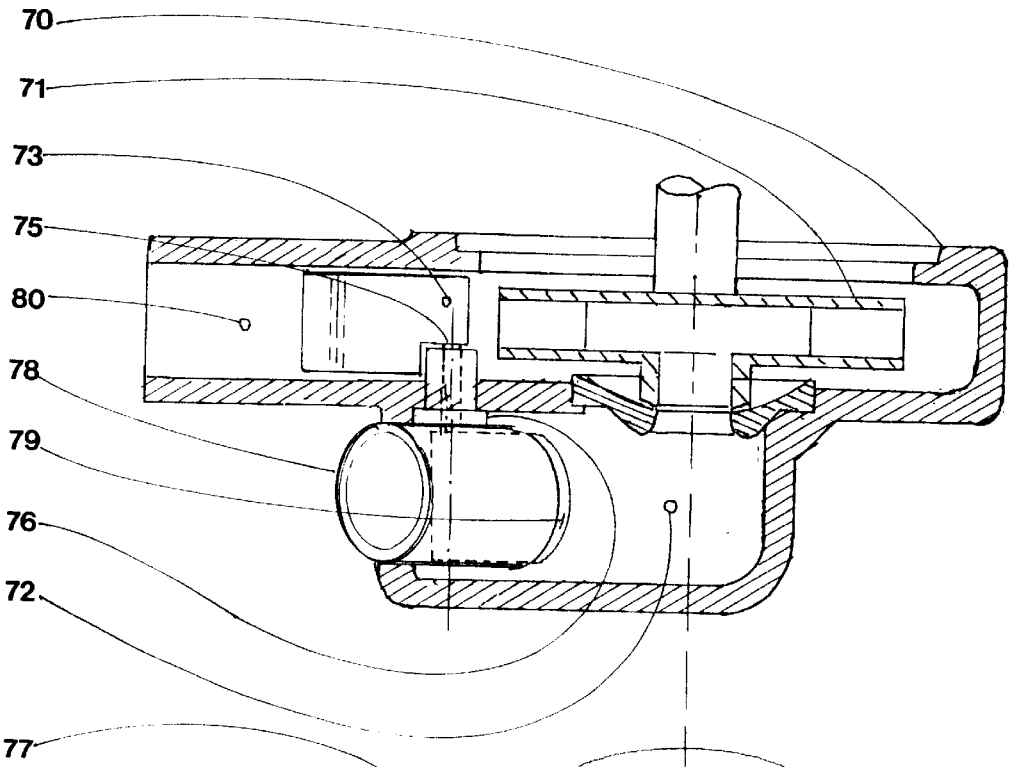
FIG. 7 shows a cross-section through a pump housing for reversal of rotation.
Figure 8:
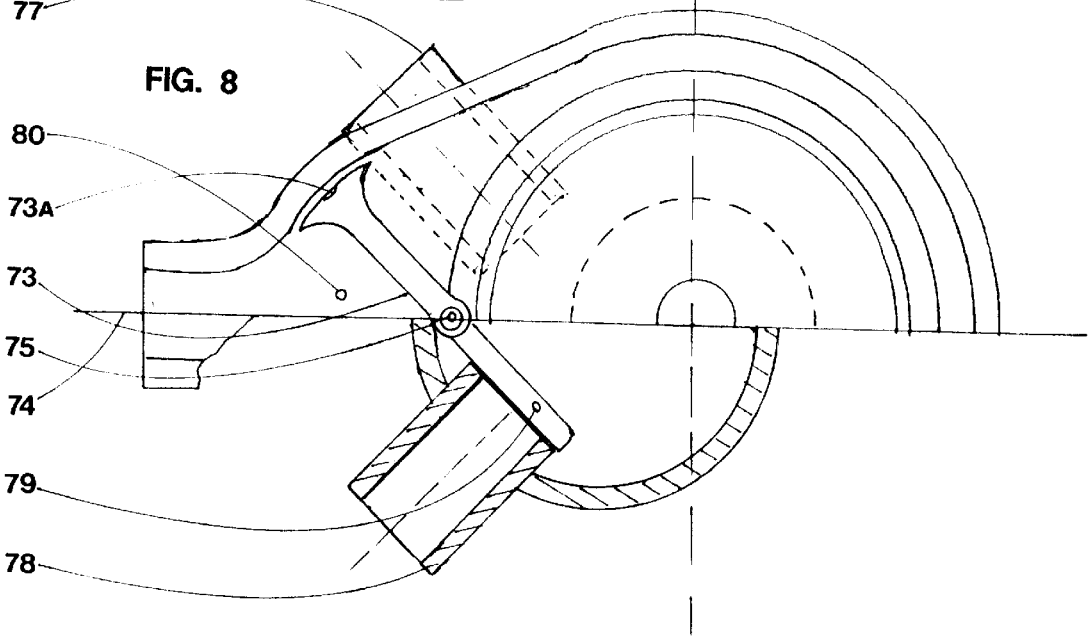
FIG. 8 shows in the upper presentation a cross-section of the pressure compartment and in the lower presentation a cross-section through the suction side.

FIGS. 7 and 8 show a cross-section of a pump housing 70 of a centrifugal pump. The pump impeller 71, preferably with radially ending vanes, sucks liquid from suction room 72. The current of the impeller turns the vane 73 into the shown position. When the direction of rotation is reversed, vane 73 turns into a position symmetrically to the symmetry axis 74. The shaft 75 of vane 73 extending into the suction area 72 is pivoted on the bearing bushing 76 made from scale repelling material (for instance polyether). Two ports 77 and 78 end within this suction area 72 whose middle axes enclose an angle of 90° between them. A flap 79 is attached to shaft 75 on the side of the suction area. This flap 79 forms together with vane 73 an angle of 180°. Flap 79 closes one of the two ports 77 or 78 and at the same time limits the angle of tilting of vane 73. The end portion 73A of vane 73 shows a surface running concentrically to shaft 75, which end portion is considerably wider than the wall thickness of vane 73.

I claim:

1. A reversible circular pump-motor-unit with a pump housing comprising a suction chamber (72) and a pressure chamber with an outlet port (80), the suction chamber (72) comprising two inlet ports (77, 78) whose axes run almost vertical to each other, a shaft (75) running parallel to the axis of rotation of the pump-motor-unit connecting a first vane (73) positioned at the pressure side and a second vane (79) positioned within the suction chamber (72) with each other, whereby the second vane (79) in a first position closes a first inlet port (78) and in a second position closes the second inlet port (77), whereby at a clockwise rotation of the pump impeller (71) the first vane (73) at the pressure side moves the second vane (79) within the suction chamber such that it closes the second inlet port (78), and at a counter-clockwise rotation of the pump impeller (71) the first vane (73) moves into the opposite position whereby the second vane (79) closes the first inlet port (77).

* * * * *